US011087945B1

(12) United States Patent
Scheele

(10) Patent No.: US 11,087,945 B1
(45) Date of Patent: Aug. 10, 2021

(54) FUSE WITH INTEGRATED HEAT SHIELD

(71) Applicant: Littelfuse, Inc., Chicago, IL (US)

(72) Inventor: Juergen Scheele, Bremen (DE)

(73) Assignee: LITTELFUSE, INC., Chicago, IL (US)

( * ) Notice: Subject to any disclaimer, the term of this patent is extended or adjusted under 35 U.S.C. 154(b) by 0 days.

(21) Appl. No.: 16/895,715

(22) Filed: Jun. 8, 2020

(51) Int. Cl.
*H01H 85/175* (2006.01)
*H01H 85/165* (2006.01)
*H01H 85/055* (2006.01)

(52) U.S. Cl.
CPC ..... *H01H 85/165* (2013.01); *H01H 85/055* (2013.01); *H01H 85/1755* (2013.01)

(58) Field of Classification Search
CPC .. H01H 69/02; H01H 85/006; H01H 85/0415; H01H 85/145; H01H 85/165; H01H 85/17; H01H 85/175; H01H 85/1755
See application file for complete search history.

(56) References Cited

U.S. PATENT DOCUMENTS 1,396,357 A * 11/1921 Clemens ..... H01H 85/165 337/247
2,091,430 A * 8/1937 Conrad ..... H01H 85/08 337/275
3,984,800 A * 10/1976 Healey, Jr. ..... H01H 85/02 337/186
3,986,158 A * 10/1976 Salzer ..... H01H 85/165 337/246
4,124,836 A * 11/1978 Wilks ..... H01H 85/165 337/186
4,344,808 A * 8/1982 Healey, Jr. ..... H01H 69/02 138/174
5,604,474 A * 2/1997 Leach ..... H01H 85/042 337/158
10,575,393 B1 * 2/2020 Bennett ..... H05K 1/0209
2015/0137934 A1 * 5/2015 von zur Muehlen ..... H01H 85/042 337/273

OTHER PUBLICATIONS

Thermal Conductivity of Common Materials and Gases. Engineering Toolbox. (Year: 2018).*

* cited by examiner

*Primary Examiner* — Jacob R Crum
(74) *Attorney, Agent, or Firm* — Kacvinsky Daisak Bluni PLLC

(57) ABSTRACT

A fuse including a fuse body, a fusible element disposed within the fuse body providing an electrically conductive pathway extending between a first end of the fuse body and a second end of the fuse body, and a heat shield disposed within the fuse body intermediate an interior surface of the fuse body and an exterior surface of the fuse body for mitigating heat flow therebetween.

17 Claims, 2 Drawing Sheets

*(A-A from Fig. 1)*

*(A-A from Fig. 1)*

FUSE WITH INTEGRATED HEAT SHIELD

FIELD OF THE DISCLOSURE

The present disclosure relates generally to the field of circuit protection devices and relates more particularly to a fuse having an integrated heat shield for mitigating the flow of heat between an interior surface and an exterior surface of a fuse body of the fuse.

FIELD OF THE DISCLOSURE

Fuses are commonly used as circuit protection devices and are typically installed between a source of electrical power and a component in a circuit that is to be protected. One type of fuse, commonly referred to as "cartridge fuse" or "tube fuse," includes a fusible element disposed within a hollow, electrically insulating fuse body. Upon the occurrence of a specified fault condition, such as an overcurrent condition, the fusible element melts or otherwise opens to interrupt the flow of electrical current between the electrical power source and the protected component.

When current flows through the fusible element of a fuse, some amount of energy is radiated from the fusible element in the form of heat, which is transmitted to and through the fuse body. In some cases, heat flowing through the fuse body may damage (e.g., melt of rupture) the fuse body, and/or may damage or obscure identifying indicia on an exterior surface of the fuse body. For example, identifying stickers adhered to the exterior surface of a fuse body may fall off, making it difficult or impossible to subsequently determine the attributes of the fuse. Moreover, variations in thermal energy transmitted through the fuse body may make the fuse operate in an unpredictable and unreliable manner. Thus, it is desirable to provide a fuse that effectively blocks or mitigates the flow of thermal energy between the interior and exterior surfaces of a fuse body.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

An exemplary embodiment of a fuse with an integrated heat shield in accordance with the present disclosure may include a first endcap covering a first end of the fuse body and a second endcap covering a second end of the fuse body, a fusible element disposed within the fuse body and extending between the first endcap and the second endcap providing an electrically conductive pathway therebetween, and a heat shield disposed within the fuse body intermediate an interior surface of the fuse body and an exterior surface of the fuse body for mitigating heat flow therebetween.

Another exemplary embodiment of a fuse with an integrated heat shield in accordance with the present disclosure may include a tubular fuse body, a fusible element disposed within the fuse body providing an electrically conductive pathway extending between a first end of the fuse body and a second end of the fuse body, and a tubular heat shield disposed within the fuse body radially intermediate an interior surface of the fuse body and an exterior surface of the fuse body for mitigating heat flow therebetween, wherein the heat shield is formed of a material having a thermal conductivity in a range between 0.02 W/(m·K) and 0.06 W/(m·K).

BRIEF DESCRIPTION OF THE DRAWINGS

By way of example, various embodiments of the disclosed techniques will now be described with reference to the accompanying drawings, wherein.

Figure 1:
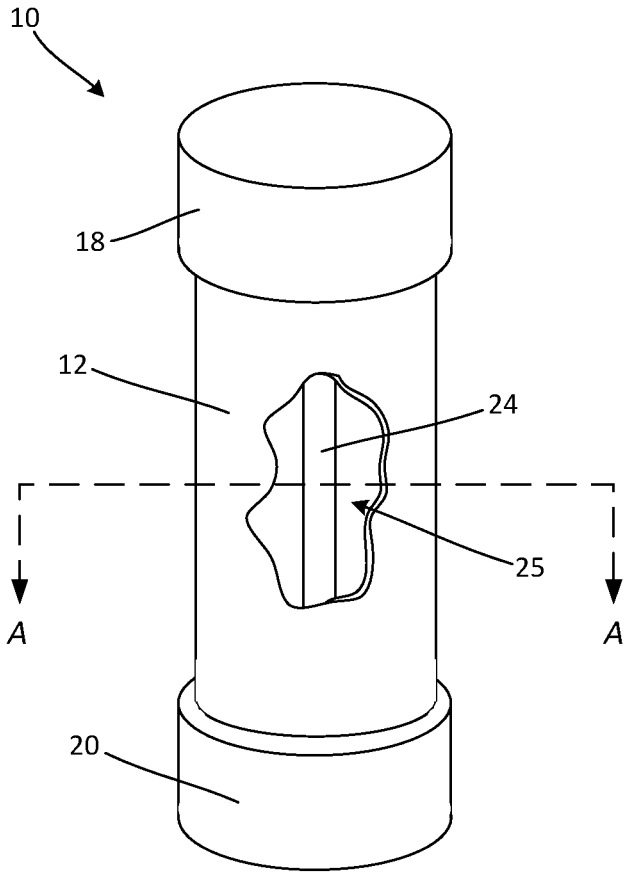
FIG. 1 is an isometric cutaway view illustrating a fuse with an integrated heat shield in accordance with an exemplary embodiment of the present disclosure.

The drawings are not necessarily to scale. The drawings are merely representations, not intended to portray specific parameters of the disclosure. The drawings are intended to depict example embodiments of the disclosure, and thus are not to be considered as limiting in scope. In the drawings, like numbering represents like elements.

Furthermore, certain elements in some of the figures may be omitted, or illustrated not-to-scale, for illustrative clarity. The cross-sectional views may be in the form of "slices", or "near-sighted" cross-sectional views, omitting certain background lines otherwise visible in a "true" cross-sectional view, for illustrative clarity. Furthermore, for clarity, some reference numbers may be omitted in certain drawings.

DETAILED DESCRIPTION

Embodiments of a fuse having an integrated heat shield in accordance with the present disclosure will now be described more fully with reference to the accompanying drawings, in which preferred embodiments of the present disclosure are presented. The fuse of the present disclosure may, however, be embodied in many different forms and should not be construed as being limited to the embodiments set forth herein. Rather, these embodiments are provided so that this disclosure will be thorough and complete, and will fully convey the scope of the fuse to those skilled in the art. In the drawings, like numbers refer to like elements throughout unless otherwise noted.

Referring to FIG. 1, an isometric cutaway view illustrating a fuse with an integrated heat shield (hereinafter "the fuse 10") in accordance with an exemplary embodiment of the present disclosure is shown. The fuse 10 may be a cartridge fuse having a tubular fuse body 12 formed of an electrically insulating material. In various alternative embodiments, the fuse 10 may be a surface mount fuse or other type of fuse having a fusible element extending through a generally hollow fuse body. The present disclosure is not limited in this regard. The fuse body 12 may be a round cylinder as shown in FIG. 1, but this is not critical. Alternative embodiments of the fuse 10 may include a fuse body that is a square cylinder, an oval cylinder, a triangular cylinder, etc. The present disclosure is not limited in this regard. The fuse body 12 may be formed of a dielectric material, including, but not limited to, melamine, ceramic, glass, etc. In various embodiments, the fuse body 12 may be formed of a dielectric material having a thermal conductivity in a range between 0.2 W/(m·K) and 0.6 W/(m·K)). The present disclosure is not limited in this regard.

A pair of electrically conductive endcaps 18, 20 may be disposed on opposing ends of the fuse body 12. A fusible element 24 may extend through the hollow interior 25 of the fuse body 12 and may be connected to the endcaps 18, 20 in electrical communication therewith, such as by solder. The endcaps 18, 20 may be formed of an electrically conductive material, including, but not limited to, copper or one of its alloys, and may be plated with nickel or other conductive, corrosion resistant coatings. In various alternative embodiments, the endcaps 18, 20 may be omitted (e.g., if the fuse 10 is connected to a holder via a terminal). The fusible element 24 may be formed of an electrically conductive material such as tin or copper, and may be configured to melt and separate upon the occurrence of a predetermined fault condition, such as an overcurrent condition in which an amount of current exceeding a predefined maximum current flows through the fusible element 24. The fusible element 24 may be any type of fusible element suitable for a desired application, including, but not limited to, a fuse wire, a corrugated strip, a fuse wire wound about an insulating core, etc. In some embodiments the fusible element 24 may extend diagonally through the hollow interior 25 of the fuse body 12. The present disclosure is not limited in this regard.

Figure 2:
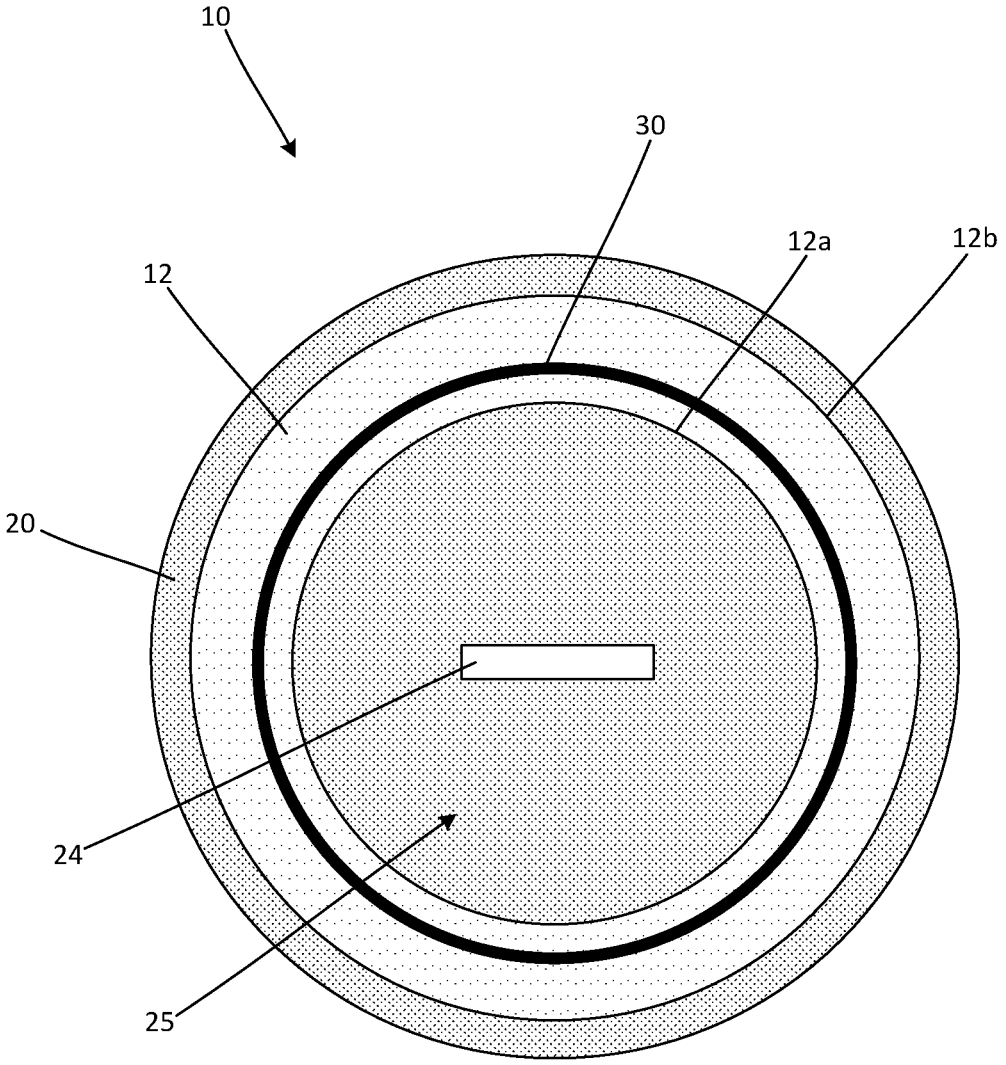
FIG. 2 is cross-sectional view illustrating the fuse shown in FIG. 1.

Referring to the cross-sectional view of the fuse 10 shown in FIG. 2, the fuse body 12 may include an integrated heat shield 30. The heat shield 30 may be a generally tubular member disposed within, and generally concentric with, the fuse body 12, such that the heat shield 30 is located radially intermediate an interior surface 12*a* and an exterior surface 12*b* of the fuse body 12. The heat shield 30 may be formed of a material having a high combustion temperature (e.g., in excess of 200 degrees Celsius) and poor thermal conductivity (e.g., thermal conductivity in a range between 0.02 W/(m·K) and 0.06 W/(m·K)). For example, in various non-limiting embodiments, the heat shield 30 may be formed of cork, glass fiber mesh, foam glass, compacted rock, stone wool, silica, etc. The present disclosure is not limited in this regard.

In various embodiments, the heat shield 30 may be embedded within the material of the fuse body 12. For example, the material of the fuse body 12 may be overmolded onto the heat shield 30 during manufacture. Alternatively, the fuse body 12 may include two separate tubular layers, one disposed radially inside the heat shield 30 and one disposed radially outside the heat shield 30, with the heat shield 30 being radially sandwiched therebetween. In yet another alternative, the fuse body 12 and the heat shield 30 may be formed of generally planar sheets of material that are arranged in flat engagement with one another (e.g., with one sheet stacked atop the other) and that are subsequently rolled together to achieve the tubular configuration shown in FIG. 2. In any case, the heat shield 30 may be located radially intermediate an interior surface 12*a* and an exterior surface 12*b* of the fuse body 12 as shown in FIG. 2 and, in certain embodiments, the heat shield 30 may be located radially nearer the interior surface 12*a* of the fuse body 12 than the exterior surface 12*b* of the fuse body 12 as shown in FIG. 2. The present disclosure is not limited in this regard. Thus, the heat shield 30 may be formed of a material that is not necessarily suitable for exposure to the fusible element 24 or electrical current flowing therethrough, but that is well suited to act as a heat shield or heat barrier between the hollow interior 25 of the fuse body 12 and the exterior surface of the fuse body 12. Cork is one example of such a material.

During operation of the fuse 10, electrical current may flow through the fusible element 24, and some amount of energy may be radiated from the fusible element 24 in the form of heat. Additional heat may be generated within the fuse 10 upon the occurrence of an overcurrent condition when the fusible element 24 separates and an electrical arc propagates between the separated portions of the fusible element 24. In any case, heat that is radiated from or otherwise generated by the fusible element 24 may be contained within the heat shield 30 and substantially prevented from flowing through the fuse body 12 to the outer surface of the fuse body 12. The fuse body 12 is thereby protected from damage that would otherwise result from being subjected to heat radiated or generated by the fusible element 24. Additionally, identifying indicia on the exterior surface of the fuse body 12 that would otherwise be damaged or obscured by heat radiated or generated by the fusible element 24 may remain legible and/or adhered to the exterior surface of the fuse body 12.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A fuse comprising:

a fuse body;

a fusible element disposed within the fuse body providing an electrically conductive pathway extending between a first end of the fuse body and a second end of the fuse body; and a heat shield disposed within the fuse body intermediate an interior surface of the fuse body and an exterior surface of the fuse body for mitigating heat flow therebetween, wherein a radially outermost surface of the heat shield is located nearer the interior surface of the fuse body than the exterior surface of the fuse body.

2. The fuse of claim 1, wherein the fuse body and the heat shield are tubular, and wherein the heat shield is disposed radially intermediate the interior surface of the fuse body and the exterior surface of the fuse body.

3. The fuse of claim 2, wherein the heat shield is embedded within a material of the fuse body.

4. The fuse of claim 2, wherein the fuse body comprises separate first and second tubular layers, wherein the first tubular layer is disposed radially inside of the heat shield and the second tubular layer is disposed radially outside of the heat shield.

5. The fuse of claim 2, wherein the fuse body and the heat shield are formed of separate sheets of material that are rolled together.

6. The fuse of claim 2, wherein the heat shield is concentric with the fuse body.

7. The fuse of claim 1, further comprising a first endcap covering the first end of the fuse body and a second endcap covering the second end of the fuse body.

8. The fuse of claim 1, wherein the heat shield is formed of a material having a combustion temperature in excess of 200 degrees Celsius.

9. The fuse of claim 1, wherein the heat shield is formed of a material having a thermal conductivity in a range between 0.02 W/(m·K) and 0.06 W/(m·K).

10. The fuse of claim 1, wherein the heat shield is formed of one of cork, glass fiber mesh, foam glass, compacted rock, stone wool, and silica.

11. A fuse comprising:

a tubular fuse body;

a first endcap covering a first end of the fuse body and a second endcap covering a second end of the fuse body;

a fusible element disposed within the fuse body and extending between the first endcap and the second endcap providing an electrically conductive pathway therebetween; and a tubular heat shield disposed within the fuse body radially intermediate an interior surface of the fuse body and an exterior surface of the fuse body for mitigating heat flow therebetween wherein a radially outermost surface of the heat shield is located nearer the interior surface of the fuse body than the exterior surface of the fuse body;

wherein the heat shield is formed of a material having a thermal conductivity in a range between 0.02 W/(m·K) and 0.06 W/(m·K).

12. The fuse of claim 11, wherein the heat shield is embedded within a material of the fuse body.

13. The fuse of claim 11, wherein the fuse body comprises separate first and second tubular layers, wherein the first tubular layer is disposed radially inside of the heat shield and the second tubular layer is disposed radially outside of the heat shield.

14. The fuse of claim 11, wherein the fuse body and the heat shield are formed of separate sheets of material that are rolled together.

15. The fuse of claim 11, wherein the heat shield is concentric with the fuse body.

16. The fuse of claim 11, wherein the heat shield is formed of a material having a combustion temperature in excess of 200 degrees Celsius.

17. The fuse of claim 11, wherein the heat shield is formed of one of cork, glass fiber mesh, foam glass, compacted rock, stone wool, and silica.

* * * * *